US006102766A

United States Patent [19]

Leadbetter et al.

[11] Patent Number: 6,102,766

[45] Date of Patent: Aug. 15, 2000

[54] TOY BUILDING SET

[75] Inventors: Paul Leadbetter, Holbæk; Arne Egholm Jensen, Gentofte, both of Denmark

[73] Assignee: INTERLEGO AG, Baar, Switzerland

[21] Appl. No.: 09/254,815

[22] PCT Filed: Sep. 16, 1997

[86] PCT No.: PCT/DK97/00387

§ 371 Date: Jun. 3, 1999

§ 102(e) Date: Jun. 3, 1999

[87] PCT Pub. No.: WO98/11968

PCT Pub. Date: Mar. 26, 1998

[30] Foreign Application Priority Data

Sep. 17, 1996 [DK] Denmark ..... 1007/96

[51] Int. Cl.[7] ..... A63H 33/08

[52] U.S. Cl. ..... 446/128; 446/124

[58] Field of Search ..... 446/128, 108, 446/116, 118, 120, 124, 432

[56] References Cited

U.S. PATENT DOCUMENTS

| | | | |
|---|---|---|---|
| 3,005,282 | 10/1961 | Christiansen . | |
| 3,162,973 | 12/1964 | Christiansen . | |
| 4,694,833 | 9/1987 | Suzuki | 446/128 |
| 5,661,941 | 9/1997 | Vataker | 446/128 |
| 5,795,210 | 8/1998 | Kushner et al. | 446/128 |

FOREIGN PATENT DOCUMENTS

| | | |
|---|---|---|
| 92683 | 1/1962 | Denmark . |
| 120627 | 6/1971 | Denmark . |
| 1 202 198 | 9/1965 | Germany . |
| 24 14 246 | 10/1975 | Germany . |
| WO 96/09869 | 4/1996 | WIPO . |

*Primary Examiner*—Sam Rimell

*Attorney, Agent, or Firm*—Pitney, Hardin, Kipp and Szuch LLP

[57] ABSTRACT

A toy building set comprises building elements (11, 21, 22) of a first type with coupling studs (10, 20) arranged in a two-dimensional periodical pattern with the coupling studs (10, 20) disposed in rows in two main directions perpendicular to each other in such a manner that the coupling studs (10, 20) also form diagonal rows in diagonal directions relative to the main directions, whereby neighboring diagonal rows are separated by a space having a width (d) wider than zero, and building elements (11, 21, 22) of a second type for interconnecting with building elements (11, 21, 22) of the first type, said building elements (11, 21, 22) of the second type having pairs of parallel coupling walls (12, 23, 24) which define cavities with coupling means for receiving coupling studs (10, 20) on building elements of the first type in a releasable engagement in such a manner that the coupling walls (12, 23, 24) are arranged in main directions between rows of coupling studs, wherein the building set further comprises building elements (40, 50, 60*a*, 60*b*, 61*a*, 61*b*, 62*a*, 62*b*) of a third type for interconnecting with building elements of the first type, said building elements (11, 21, 22) of the first type having pairs of parallel coupling walls (42, 52) that define cavities with coupling means for receiving coupling studs (10, 20) on other building elements in releasable engagement whereby the coupling walls (42, 52) are arranged in diagonal directions in spaces between diagonal rows of coupling studs.

3 Claims, 5 Drawing Sheets

TOY BUILDING SET

The present invention relates to a toy building set or building system with interconnectable building elements, and more specifically such building elements which are provided on the one side with coupling studs and on another with pairs of parallel coupling walls which define cavities with coupling means for receiving coupling studs on another building element in a releasable engagement.

Such toy building systems are known i.a. from U.S. Pat. No. 3,005,282, and they feature coupling studs arranged in rows in main directions perpendicular to each other whereby the studs form a square pattern. Building elements with pairs of parallel coupling walls are arranged with the coupling walls, which are most frequently the outer delimiting walls of the building elements, disposed in spaces between rows of coupling studs. In such a square pattern, the coupling studs will also form diagonal directions between the main directions, and in building sets marketed under the trade marks LEGO® or DUPLO®, a space is provided between diagonal rows with a width wider than zero.

DE 2,414,246 teaches a building element with studs substantially perpendicular to each other. In each main row, large and small studs alternate in such a pattern that they also form diagonal rows. The diameters of the large studs and the diameters of the small studs as well as the relative distances of the studs are so adapted that a building block with walls that define a cavity in the underside of the building block may optionally be so arranged that two parallel walls on the building block either spans large studs in main rows or small studs in diagonal rows.

U.S. Pat. No. 3,162,973 illustrates toy building blocks with outer walls that are perpendicular to each other and define a cavity in the underside of the building block. In this cavity there are diagonally extending walls. However, the building blocks can only be interconnected with their outer walls in the main directions of the studs.

A toy building set according to the invention further provides building elements with coupling walls which are arranged to be situated in diagonal directions in spaces between diagonal rows of coupling studs. Hereby novel building options become available.

Figure 1:
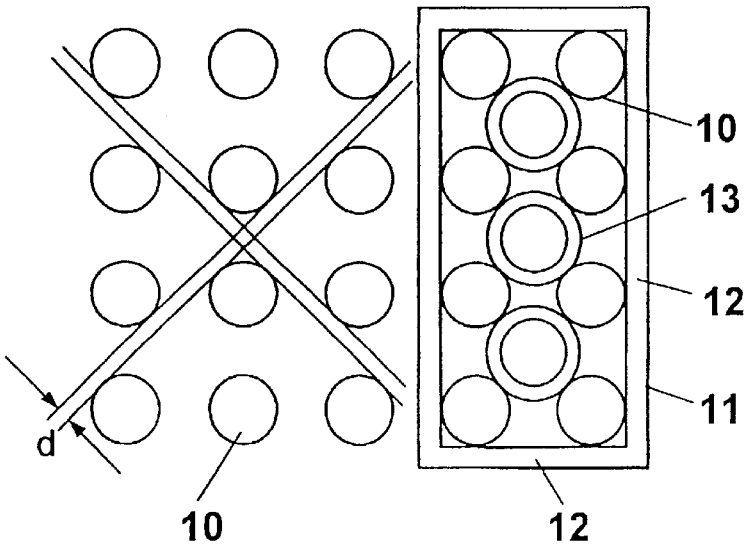
Figure 2:
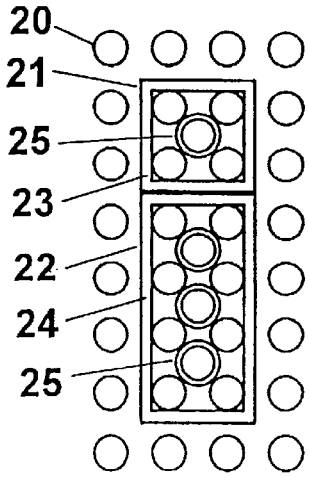
Figure 3:
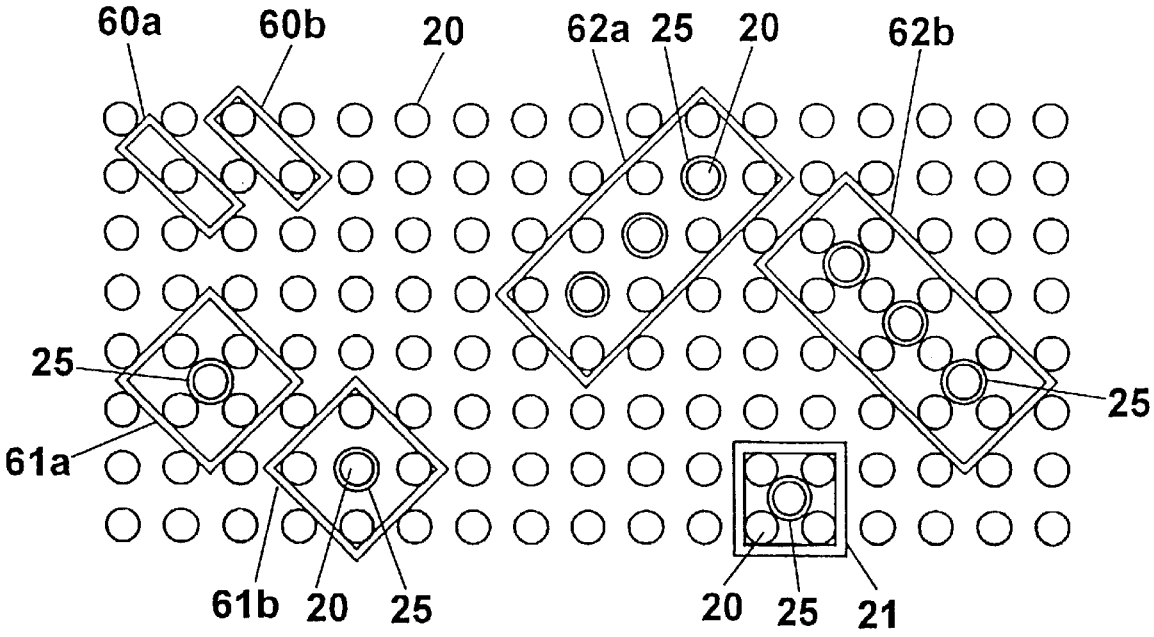
Figure 4:
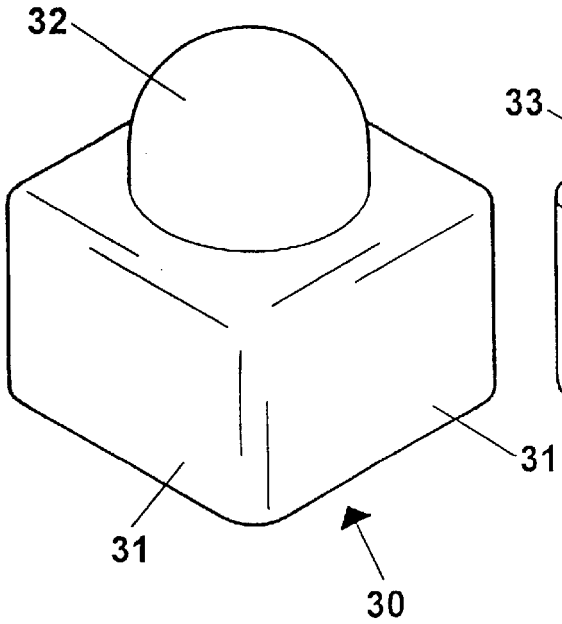
Figure 5:
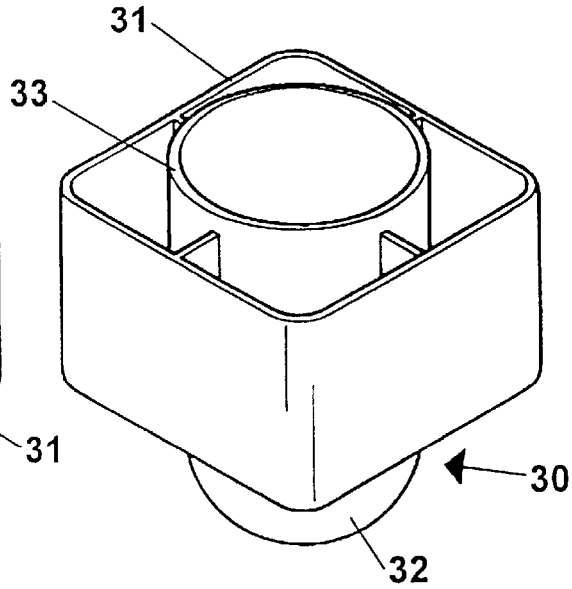
Figure 6:
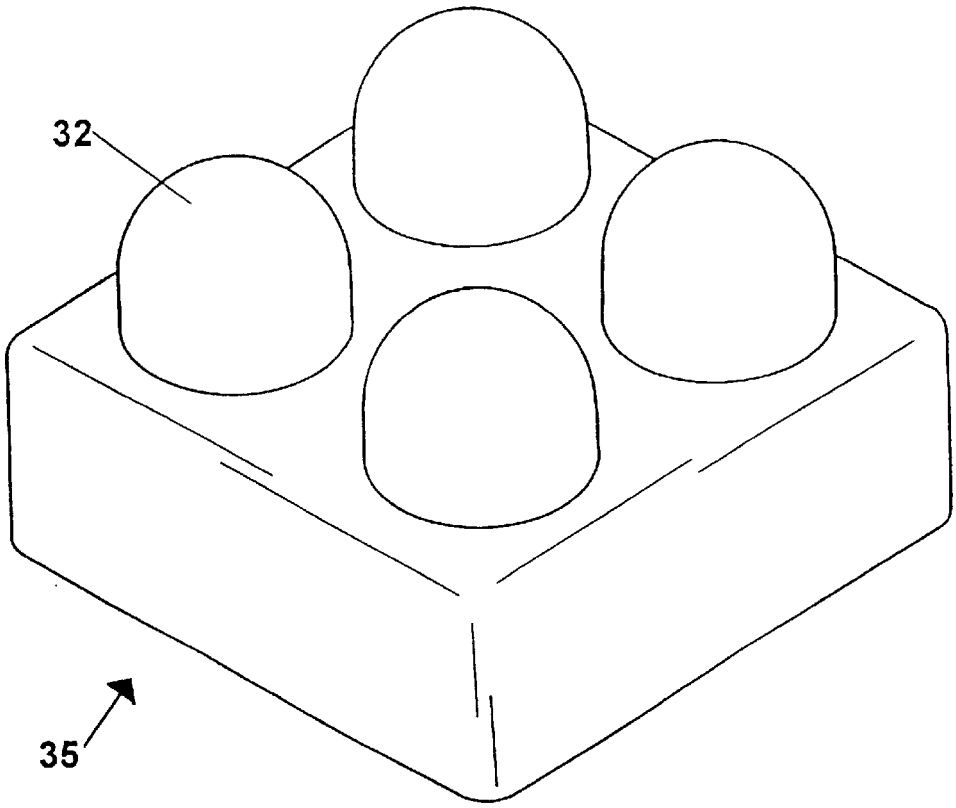
Figure 7:
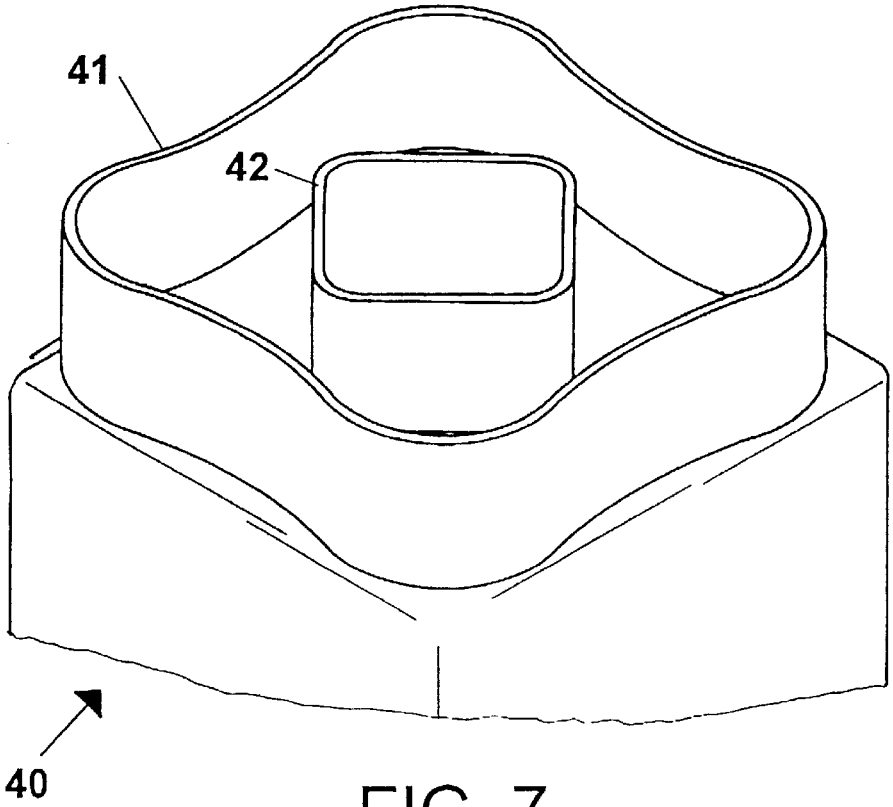
Figure 8:
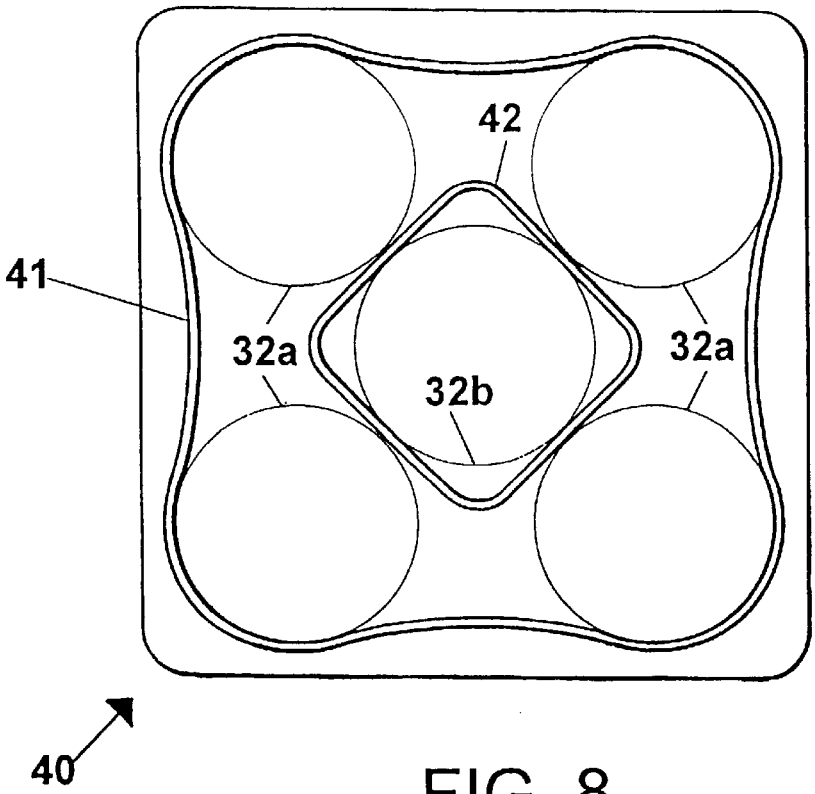
Figure 9:
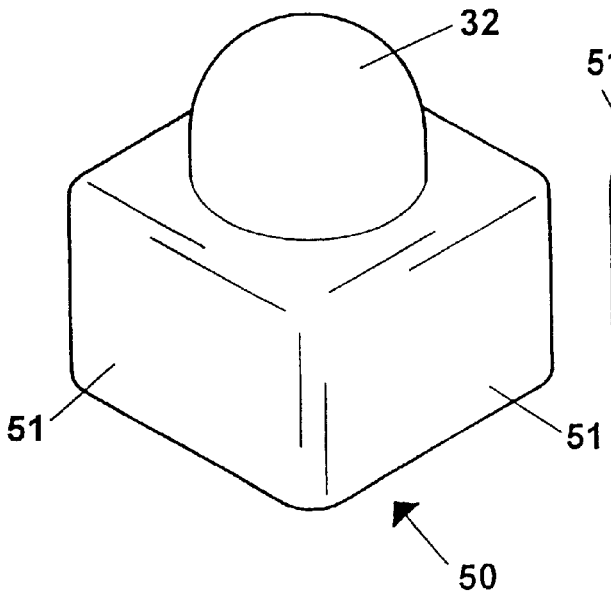
Figure 10:
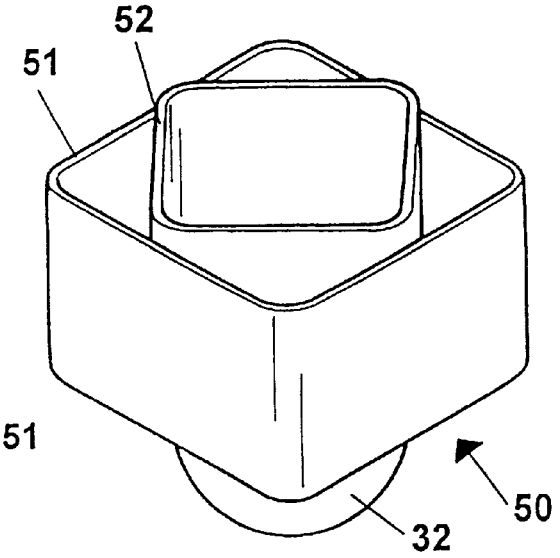

The invention will now be described in further detail with reference to the drawings, wherein FIG. 1 is a schematical, sectional view of a prior art toy building element with coupling studs arranged in directions perpendicular to each other, FIG. 2 is a schematical view of assembled building elements from a known toy building set, FIG. 3 is a schematical view of a toy building set according to the invention, FIGS. 4 and 5 are perspective views of a known toy building element seen from the top and from below, respectively, FIG. 6 is a perspective top view of a further known toy building element, FIG. 7 is a partial, perspective view of a novel toy building element seen from below for use in the toy building set according to the invention, FIG. 8 is a direct bottom view of the toy building element illustrated in FIG. 7, FIGS. 9 and 10 illustrate an alternative novel toy building element for use in toy building sets according to the invention, seen from the top and the bottom, respectively.

Figure 11:
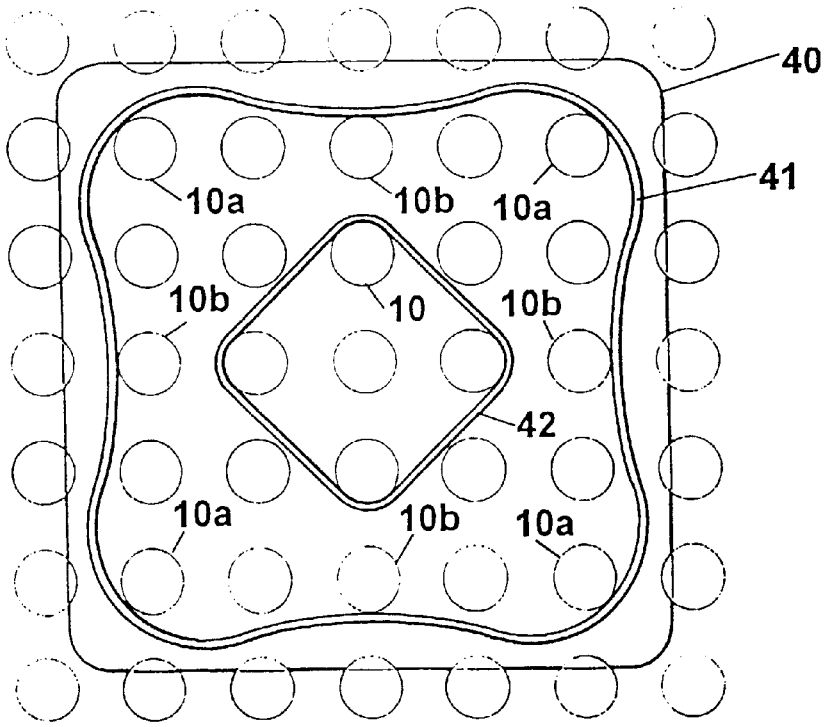
Figure 12:
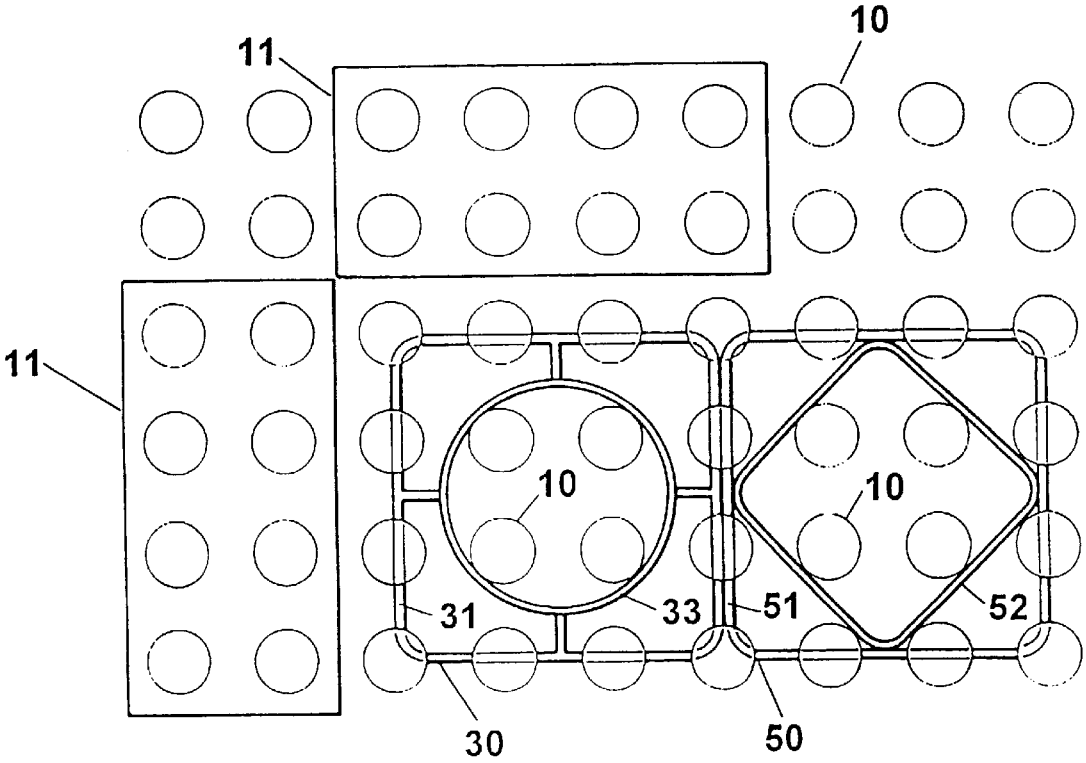
Figure 13:
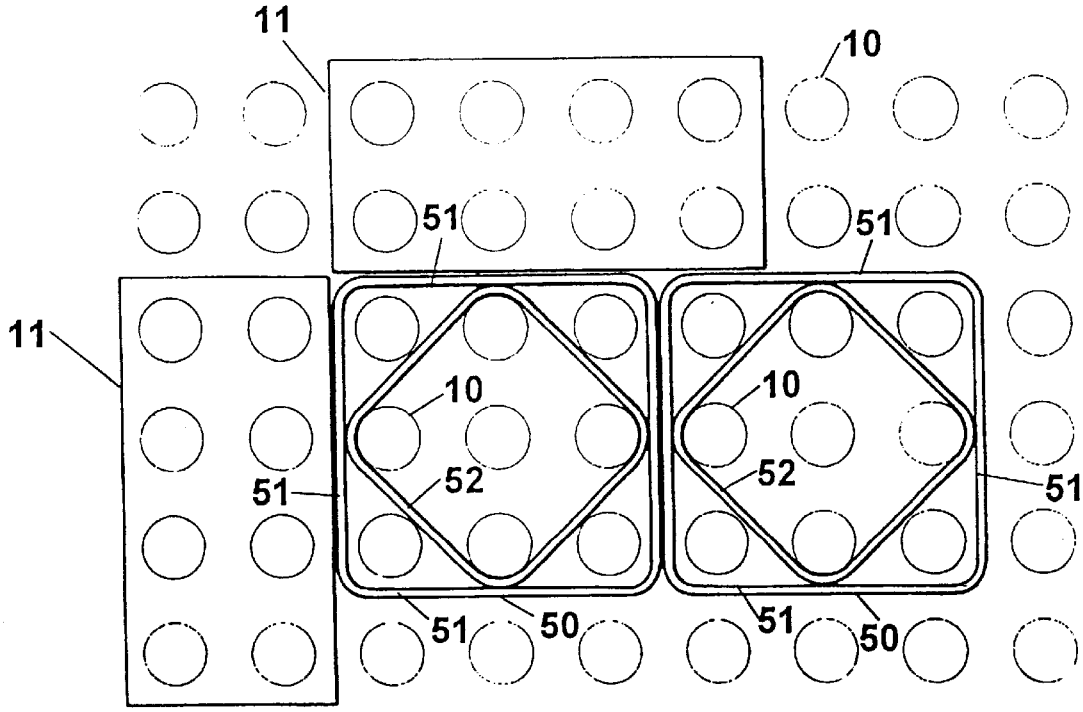

FIG. 11 is a schematical view of the building element illustrated in FIGS. 7 and 8, in connection with a toy building element with coupling studs of the same type as illustrated in FIG. 1, FIG. 12 is a schematical view of a building set according to the invention with the building elements shown in FIGS. 4, 5, 7 and 8 in combination with other known building elements, and FIG. 13 is a schematical view of the building set illustrated in FIG. 10 with two building elements like in FIGS. 7 and 8.

FIG. 1 shows a known arrangement of cylindrical coupling studs 10 arranged in four by five rows in main directions perpendicular to each other on an outer surface of a not shown building element, such as a building plate. The building set shown in FIG. 1 is a DUPLO® building set. Identical spaces are provided between the coupling studs in the two main directions whereby the studs form a square pattern. A DUPLO® toy building element 11 has coupling walls 12 arranged in spaces between rows of coupling studs in main directions, and the insides of the coupling walls are in contact with two rows of coupling studs 10. In the cavity defined by the coupling walls 12, the building element 11 is provided with coupling means in the form of coupling tubes 13 which are in contact with four coupling studs 10 and thereby couple thereon.

The coupling studs in the square pattern shown in FIG. 1 moreover form rows in diagonal directions which form angles of 45° relative to the main directions. Between diagonal rows there is a space with a width d.

FIG. 2 illustrates another known arrangement of cylindrical coupling studs 20 which are here arranged in four by eight rows which also have main directions perpendicular to each other on an outer surface of a not shown building element, such as a building plate. The building set illustrated in FIG. 2 is a LEGO SYSTEM® building set. Also in this building set, eqal spaces between the coupling studs in the two main directions are provided whereby the studs form a square pattern. Like in FIG. 1, two building elements 21 and 22 are affixed on the coupling studs 20 in FIG. 2. The building elements 21 and 22 are arranged with their coupling walls 23 and 24 in spaces between coupling studs in the main directions and in contact with coupling studs 20. In the cavities defined by the respective coupling walls of the building elements 21 and 22, the tubular coupling means or coupling tubes 25 described in U.S. Pat. No. 3,005,282 are provided. The coupling tubes 25 are in contact with four coupling studs 20 and their internal diameter corresponds to the outer diameter of a coupling stud 20.

FIG. 4 and 5 illustrate a known toy building element 30 which constitutes a part of the toy building system described in WO 96/09869 and marketed under the trade mark PRIMO®. The building element 30 has a box-shaped base part with a substantially square horizontal cross section and rounded edges. The building element 30 has four outer delimiting walls 31 and on the upper surface of the element, a coupling stud 32 is provided. At the bottom, the coupling stud 32 is provided with a short cylindrical portion, and at the top a semisphere with the same diameter as the cylindrical portion. The outer delimiting walls 31 of the building element define or delimit a cavity in the bottom of the element, and in this cavity a coupling means 33 is provided in the form of a cylindrical coupling tube with an internal diameter corresponding to the diameter of the coupling stud 32 whereby the coupling stud 32 may be received in the coupling tube 33. The diameters of the coupling stud 32 and the coupling tube 33 may be adapted to each other to allow them to be interconnected without significant friction which renders such building elements suitable as stacking blocks for quite small children, or with a friction which produces a certain holding force. The lowermost portion of the coupling tube 33 extends a certain distance below the outer delimiting walls 31 of the element.

FIG. 6 illustrates another toy building element 35 which is a part of the toy building system disclosed in WO 96/09869 like the element 30 in FIGS. 4 and 5. The element 35 is provided with four coupling studs 32 which are each identical with the coupling stud 32 on the element 30 and on the element 35 these four coupling studs are arranged in a square. In a manner corresponding to that of the element 30, the underside of the element 35 is provided with a tubular coupling skirt below each of the four coupling studs (not shown).

FIGS. 7 and 8 illustrate a novel toy building element 40. From the bottom of the coupling skirt 40 an outer coupling skirt 41 and an inner coupling skirt 42 protrude downwards. By means of the coupling skirts 41 and 42 the building element 40 may be combined with toy building elements in the building system in the disclosures of WO 96/09869, such as the element 30 in FIGS. 4 and 5 or the element 35 in FIG. 6. The single coupling stud 32 on the element 30 may with or without friction be received in each of the four shown positions 32*a* in the space between the outer coupling skirt 41 and the inner coupling skirt 42 and moreover in the shown one position 32*b* in the inner coupling skirt 42. Moreover the four coupling studs 32 on the element 35 may be received with or without friction in the four positions 32*a*.

FIG. 11 illustrates how the toy building element 40 may also be combined with a DUPLO® building element, in this case a building plate with DUPLO® coupling studs 10. The outer coupling skirt 41 spans or encloses five by five coupling studs 10 in a square and its inside is in contact with the four coupling studs 10*a* which are located at the corners of the square, and four studs 10*b* centrally on the sides of the square, and thus the outer coupling skirt 41 constitutes a wall which is arranged in spaces between rows of coupling studs in the main directions. The inner coupling skirt 42 spans or encloses five coupling studs 10 situated in two intersecting rows in the main directions, and the inner coupling skirt constitutes walls which are arranged in spaces between rows of coupling studs in the diagonal directions.

FIGS. 9 and 10 illustrate a novel toy building element 50 which, like the building element 30 in FIGS. 4 and 5, has a box-shaped base part with a substantially square cross section and rounded edges, four outer delimiting walls 51 and a coupling stud. The building element 50 differs from the building element 30 in FIGS. 4 and 5 substantially only by the cavity defined by the outer delimiting walls 51 being provided with a coupling skirt 52 with the same dimensions as the inner coupling skirt 42 on the building element of FIGS. 7, 8 and 11. The building element 50 may hereby be interconnected with other building elements which have DUPLO® coupling studs 10 with its coupling skirt 52 arranged in spaces between diagonal rows of coupling studs 10.

FIG. 12 illustrates two DUPLO® building elements 11 and a PRIMO® building element 30 affixed on a building plate with DUPLO® coupling studs 10. The PRIMO® building element 30 is shown in a known position where its coupling skirt 33 encloses four coupling studs 10, where the element is capable of rotating about said four studs as taught in WO 96/09869 provided there are no neighboring elements to restrict its freedom to do so. The PRIMO® building element 30 cannot be stacked in completely close abutment on the DUPLO® building elements and its outer delimiting walls 31 cannot be caused to align with the outer delimiting walls of the DUPLO® elements. This is due to the fact that the distance between the outer delimiting walls of the PRIMO® element and the DUPLO® elements is exactly half of the distance between two neighboring coupling studs 10, and this distance constitutes the smallest possible interval which the DUPLO® as well as the PRIMO® elements may be moved on the coupling studs 10.

FIG. 12 also illustrates a novel building element 50 arranged in substantially close abutment on the PRIMO® building element 30. Here the coupling skirt 52 on the building element 50 encloses four coupling studs 10 and upright portions or walls of the coupling skirt 52 are arranged in spaces between diagonal rows of coupling studs 10. The novel building element 50 is thus arranged in a position on the coupling studs 10 which corresponds exactly to the position of the PRIMO® element. However, the novel building element 50 will be prevented from rotating in a position where it is stacked on DUPLO® coupling studs 10.

Like the coupling skirt 42 on the building element 40, the coupling skirt 52 is also capable of being stacked on a PRIMO® coupling stud 32 of other building elements. Except from being prevented from rotating the novel building element 50 thus has the exact same building options available as the known PRIMO® building element 30. Its rotatability is prevented by the very fact that the upright coupling walls of the coupling skirts are arranged in spaces between diagonal rows of coupling studs.

FIG. 13 illustrates two novel building elements 50 and two DUPLO® building elements 11 affixed on a building plate with DUPLO® coupling studs 10. Here the building elements 50 are arranged in such a manner that their coupling skirts 52 enclose five coupling studs 10 in the same manner as the coupling skirt 42 in FIG. 11. The building elements 50 are arranged with the outer delimiting walls 51 disposed in the main directions and substantially in close abutment on the DUPLO® building elements 11. Moreover, it will appear that a DUPLO® building element 11 and a novel building element 50 have outer delimiting walls which are aligned with each other or are in substantially the same plane perpendicular to the building plate.

Thus, the building elements with the novel coupling skirt 42 or 52 with walls intended for arrangement in spaces between diagonal rows of coupling studs have exactly the same coupling positions as the known PRIMO® elements, and in addition new coupling positions which are diagonally displaced half the distance between the neighboring coupling studs in diagonal direction. Hereby the number of coupling positions is doubled.

FIG. 3 illustrates an alternative embodiment of the toy building system according to the invention. Here a known LEGO SYSTEM® building plate is used with coupling studs 20 arranged in rows in main directions perpendicular to each other. Like in FIG. 1, here a (not shown) space is provided between diagonal rows of coupling studs 20. A known building element 21 is shown that encloses four coupling studs 20 and has a coupling tube 25 which touches the four coupling studs 20.

Moreover FIG. 3 illustrates toy building elements 60*a*, 60*b*, 61*a*, 61*b*, 62*a* and 62*b* which all have coupling walls arranged in spaces between diagonal rows of coupling studs 20. The building elements 60*a* and 60*b* are identical and shown in the two different coupling positions where they enclose one and two coupling studs 20, respectively. Moreover, the elements 61*a* and 61*b* are identical and shown in their two coupling positions where they enclose four and five coupling studs 20, respectively. Finally, the elements 62*a* and 62*b* are also identical and enclose eleven and twelve coupling studs 20, respectively.

Like the building elements 21 and 22, the building elements 61*a*, 61*b*, 62*a* and 62*b* have cylindrical coupling tubes 25 in the cavities defined by their coupling walls. These coupling walls 25 have a coupling position in both the shown coupling positions, since the coupling tubes couple either with their outsides on four coupling studs 20, like in FIG. 2, or with their insides about one single coupling stud 20.

Like the building element 50, the building elements 60*a*, 60*b*, 61*a*, 61*b*, 62*a* and 62*b* may be provided with outer delimiting walls in the main directions or with outer delimiting walls in diagonal directions, thereby allowing these delimiting walls to be stacked in substantially close proximity to each other.

The building elements 50, 60*a*, 60*b*, 61*a*, 61*b*, 62*a* and 62*b* will always be able to have either an even or an uneven number of coupling studs 20 between their coupling walls where the difference between the even and the uneven number is always 1.

What is claimed is:

1. A toy building set comprising building elements (11, 21, 22) of a first type with uniform coupling studs (10, 20) arranged in a two-dimensional periodical pattern with the coupling studs (10, 20) arranged in rows in two main directions perpendicular to each other in such a manner that the coupling studs also form diagonal rows in diagonal directions relative to the main directions, whereby a space having a width (d) wider than zero is provided between neighboring diagonal rows, and building elements (11, 21, 22) of a second type for interconnecting with building elements (11, 21, 22) of the first type, the building elements (11, 21, 22) of the second type having pairs of parallel coupling walls (12, 23, 24) which define cavities for receiving coupling studs (10, 20) on building elements of the first type in a releasable frictional engagement in such a manner that the coupling walls (12, 23, 24) are arranged in main directions between rows of coupling studs, wherein the building set further comprises building elements (40, 50, 60*a*, 60*b*, 61*a*, 61*b*, 62*a*, 62*b*) of a third type for interconnecting with building elements (11, 21, 22) of a first type, the building elements (40, 50, 60*a*, 60*b*, 61*a*, 61*b*, 62*a*, 62*b*) of the third type having a first pair of parallel coupling walls (42, 52) receivable in spaces between diagonal rows of coupling studs, and a second pair of parallel coupling walls, perpendicular to the first pair of coupling walls, receivable in spaces between diagonal rows of coupling studs, the first and second pairs of coupling walls defining a cavity for receiving coupling studs (10, 20) on building element of the first type in a releasable engagement, whereby the coupling walls (42, 52) of the first and second pairs each have a thickness which corresponds to the width (d) of the space between neighboring diagonal rows, the coupling walls (42, 52) of the first and second pairs being the sole coupling walls on the building elements of the third type receivable between rows of coupling studs.

2. A toy building set according to claim 1, wherein the building elements (40, 50, 60*a*, 60*b*, 61*a*, 61*b*, 62*a*, 62*b*) of the third type have outer delimiting walls (51), which extend beyond the coupling walls (42, 52) of the elements.

3. A toy building set according to claim 1, wherein the outer delimiting walls (51) are situated in the main directions upon combination with building elements (11, 21, 22) of the first type.

* * * * *